US012529204B2

(12) United States Patent
Stolz

(10) Patent No.: US 12,529,204 B2
(45) Date of Patent: Jan. 20, 2026

(54) HITCH ASSEMBLY FOR BUCKET

(71) Applicant: Caterpillar Global Mining LLC, Tucson, AZ (US)

(72) Inventor: Michael Robert Stolz, Franklin, WI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 748 days.

(21) Appl. No.: 17/822,290

(22) Filed: Aug. 25, 2022

(65) Prior Publication Data

US 2024/0068198 A1 Feb. 29, 2024

(51) Int. Cl.
*E02F 3/60* (2006.01)
*E02F 3/48* (2006.01)
*E02F 3/58* (2006.01)

(52) U.S. Cl.
CPC ..... *E02F 3/60* (2013.01); *E02F 3/48* (2013.01); *E02F 3/58* (2013.01)

(58) Field of Classification Search
CPC ... E02F 3/48; E02F 3/60; E02F 3/7622; E02F 3/58
USPC ..... 37/333, 341, 399
See application file for complete search history.

(56) References Cited

U.S. PATENT DOCUMENTS 881,330 A * 3/1908 Newman ..... E02F 3/48 37/395
1,490,387 A * 4/1924 Hansen ..... E02F 3/60 37/398
1,497,017 A * 6/1924 Hansen ..... E02F 3/60 37/396
1,908,686 A * 5/1933 Burke ..... E02F 3/60 37/399
2,295,717 A * 9/1942 Crawford ..... E02F 5/006 37/341
2,359,303 A * 10/1944 Davidson ..... E02F 3/60 37/396
3,112,572 A * 12/1963 Larsen ..... E02F 3/60 294/68.27
3,421,776 A * 1/1969 Stockburger ..... A01D 34/74 280/43.17
4,791,738 A * 12/1988 Briscoe ..... E02F 9/14 37/399
4,864,747 A * 9/1989 Martin ..... E02F 3/60 37/399
5,137,161 A 8/1992 Dutton
(Continued)

*Primary Examiner* — Christopher J Sebesta
*Assistant Examiner* — Audrey L Lusk

(57) ABSTRACT

A hitch assembly for a bucket of a work machine includes a bracket adapted to be removably coupled with the bucket at any one of a plurality of hitch locations. The bracket defines a first bracket end and a second bracket end. The bracket is adapted to be coupled with a drag chain proximal to the first bracket end. The hitch assembly also includes one or more first mechanical fasteners adapted to removably couple the bracket with the bucket. The hitch assembly further includes a second mechanical fastener adapted to be coupled with each of the bucket and the bracket proximal to the second bracket end. Based on a removal of the one or more first mechanical fasteners from the bucket and the bracket, the bracket and the second mechanical fastener rotate relative to the bucket for disposing the bracket at any one of the plurality of hitch locations.

20 Claims, 11 Drawing Sheets

(56) References Cited

U.S. PATENT DOCUMENTS

| | | | | |
|---|---|---|---|---|
| 5,400,530 | A * | 3/1995 | Schmidt | E02F 3/60 37/399 |
| 8,950,091 | B2 | 2/2015 | Cover | |
| 9,587,375 | B2 * | 3/2017 | Carbaugh | E02F 5/025 |
| 9,982,412 | B1 * | 5/2018 | Stolz | E02F 3/48 |
| 2007/0240341 | A1 * | 10/2007 | Hyde | E02F 9/28 37/398 |
| 2015/0292177 | A1 * | 10/2015 | Leslie | E02F 3/60 37/444 |
| 2017/0089034 | A1 * | 3/2017 | Falkenhagen | E02F 9/285 |
| 2018/0274203 | A1 * | 9/2018 | Plouzek | E02F 9/2016 |
| 2021/0246935 | A1 | 8/2021 | Grewell et al. | |

* cited by examiner

HITCH ASSEMBLY FOR BUCKET

TECHNICAL FIELD

The present disclosure relates to a hitch assembly for a bucket of a work machine, such as, a dragline excavator.

BACKGROUND

Machines, such as dragline excavators, typically include a dragline bucket associated therewith. The dragline bucket may be used in mining and earth moving operations. For example, the dragline bucket may be used to excavate and hold materials, such as, rocks/aggregate, or other large finds. The dragline bucket is suspended from a boom of the machine by a rigging assembly. The dragline bucket is maneuvered by means of the rigging assembly. For example, the rigging assembly may include multiple chains that connect with the dragline bucket. In an example, a linkage may be used to connect a corresponding chain with the dragline bucket.

Conventionally, as the dragline bucket is used to dig deeper into a ground surface, the chain of the rigging assembly may have to be moved to a higher hitch location on the dragline bucket, which may allow teeth of the dragline bucket to engage into the soil without the dragline bucket heeling over. For connecting the chain at another hitch location, an operator may have to remove a pin that connects the linkage with the dragline bucket. Further, the operator may have to manually move the linkage to different hitch locations, as per application requirements. As the components of the rigging assembly are generally heavy, it may be cumbersome for the operator to handle such heavy components and, in some examples, a crane may be required to move the linkage.

U.S. Pat. No. 4,791,738 describes a dragline bucket wherein the center of gravity is along a line making an angle of at least 90° with a line from the tooth tip to the horizontal pivot axis of the dragline hitch. The disclosure also describes a movable hitch.

SUMMARY OF THE DISCLOSURE

In an aspect of the present disclosure, a hitch assembly for a bucket of a work machine is provided. The hitch assembly includes a bracket adapted to be removable coupled with the bucket at any one of a plurality of hitch locations. The bracket defines a first bracket end and a second bracket end opposite the first bracket end. The bracket is adapted to be coupled with a drag chain proximal to the first bracket end. The hitch assembly also includes one or more first mechanical fasteners adapted to removably couple the bracket with the bucket. The hitch assembly further includes a second mechanical fastener adapted to be coupled with each of the bucket and the bracket proximal to the second bracket end. Based on a removal of the one or more first mechanical fasteners from the bucket and the bracket, the bracket and the second mechanical fastener is adapted to rotate relative to the bucket for disposing the bracket at any one of the plurality of hitch locations.

In another aspect of the present disclosure, a bucket assembly for a work machine is provided. The bucket assembly includes a bucket. The bucket assembly also includes a hitch assembly adapted to be coupled to the bucket. The hitch assembly includes a bracket adapted to be removably coupled with the bucket at any one of a plurality of hitch locations. The bracket defines a first bracket end and a second bracket end opposite the first bracket end. The bracket is adapted to be coupled with a drag chain proximal to the first bracket end. The hitch assembly also includes one or more first mechanical fasteners adapted to removably couple the bracket with the bucket. The hitch assembly further includes a second mechanical fastener adapted to be coupled with each of the bucket and the bracket proximal to the second bracket end. Based on a removal of the one or more first mechanical fasteners from the bucket and the bracket, the bracket and the second mechanical fastener is adapted to rotate relative to the bucket for disposing the bracket at any one of the plurality of hitch locations.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
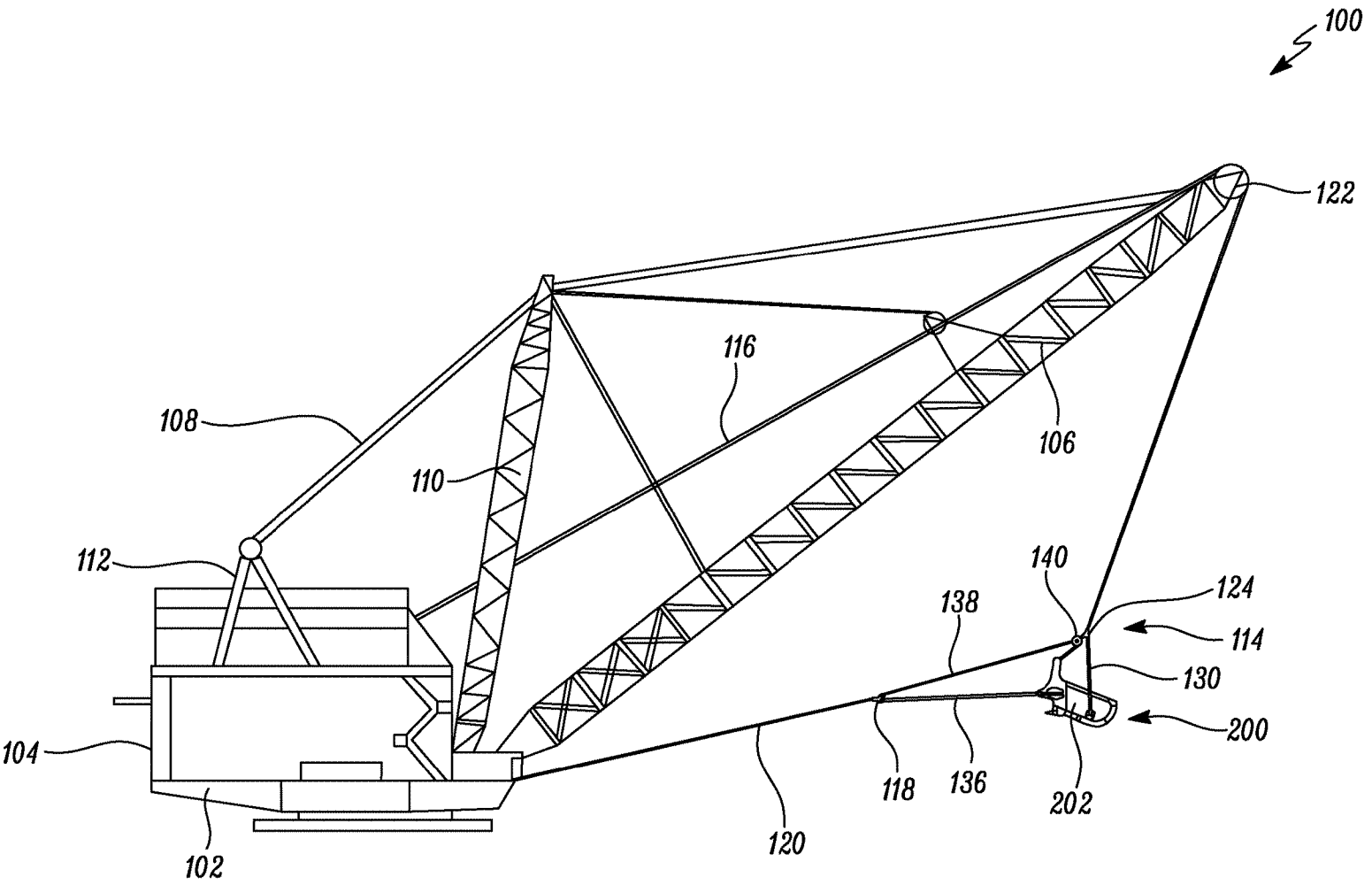
FIG. 1 is a schematic side view of a work machine, according to an example of the present disclosure.

FIG. 1 illustrates a schematic side view of an exemplary work machine 100. The work machine 100 is embodied as a dragline excavator herein. Alternatively, the work machine 100 may include another type of earthmoving machine. The work machine 100 may perform one or more operations associated with an industry, such as, mining, construction, forestry, farming, transportation, or any other industry known in the art. The work machine 100 may be embodied as a manual, an autonomous, or a semi-autonomous machine, without any limitations.

The work machine 100 includes a frame 102. Further, the work machine 100 also includes an enclosure 104. The work machine 100 further includes a power source (not shown). In addition to other components, the enclosure 104 may house the power source. The power source may supply power to various components of the work machine 100 for operating one or more components of the work machine 100 and also facilitates a movement of the work machine 100. In one example, the power source may include an engine, such as, a diesel engine, a gasoline engine, a gaseous fuel-powered engine, or any other type of engine known in the art. In other examples, the power source may include a battery system.

Although now shown herein, the work machine 100 may include ground engaging members, such as, wheels, tracks, or a walking mechanism for mobility. The work machine 100 includes a boom 106. The boom 106 is controlled by a suspension system 108 connected to a mast 110 and a gantry frame 112. The work machine 100 further includes a rigging assembly 114 coupled to one or more hoist ropes 116.

The present disclosure describes a bucket assembly 200 for the work machine 100. The bucket assembly 200 is coupled to the rigging assembly 114. The bucket assembly 200 includes a bucket 202. The bucket 202 is embodied as a dragline bucket herein. Further, the rigging assembly 114 includes a drag socket 118 and one or more drag ropes 120. The hoist ropes 116 pass over a boom point sheave 122 of the boom 106 and suspends the bucket 202 therefrom. Further, the bucket 202 is coupled to the drag ropes 120 by the drag socket 118.

The rigging assembly 114 includes a hoist socket 124 and a spreader bar (not shown). The rigging assembly 114 further includes a number of hoist chains 130. The spreader bar along with the hoist chains 130 suspends the bucket 202. Further, the bucket 202 can be moved by the drag chains 136 and a dump rope 138 that is connected to the bucket 202 by a dump sheave 140.

Figure 2:
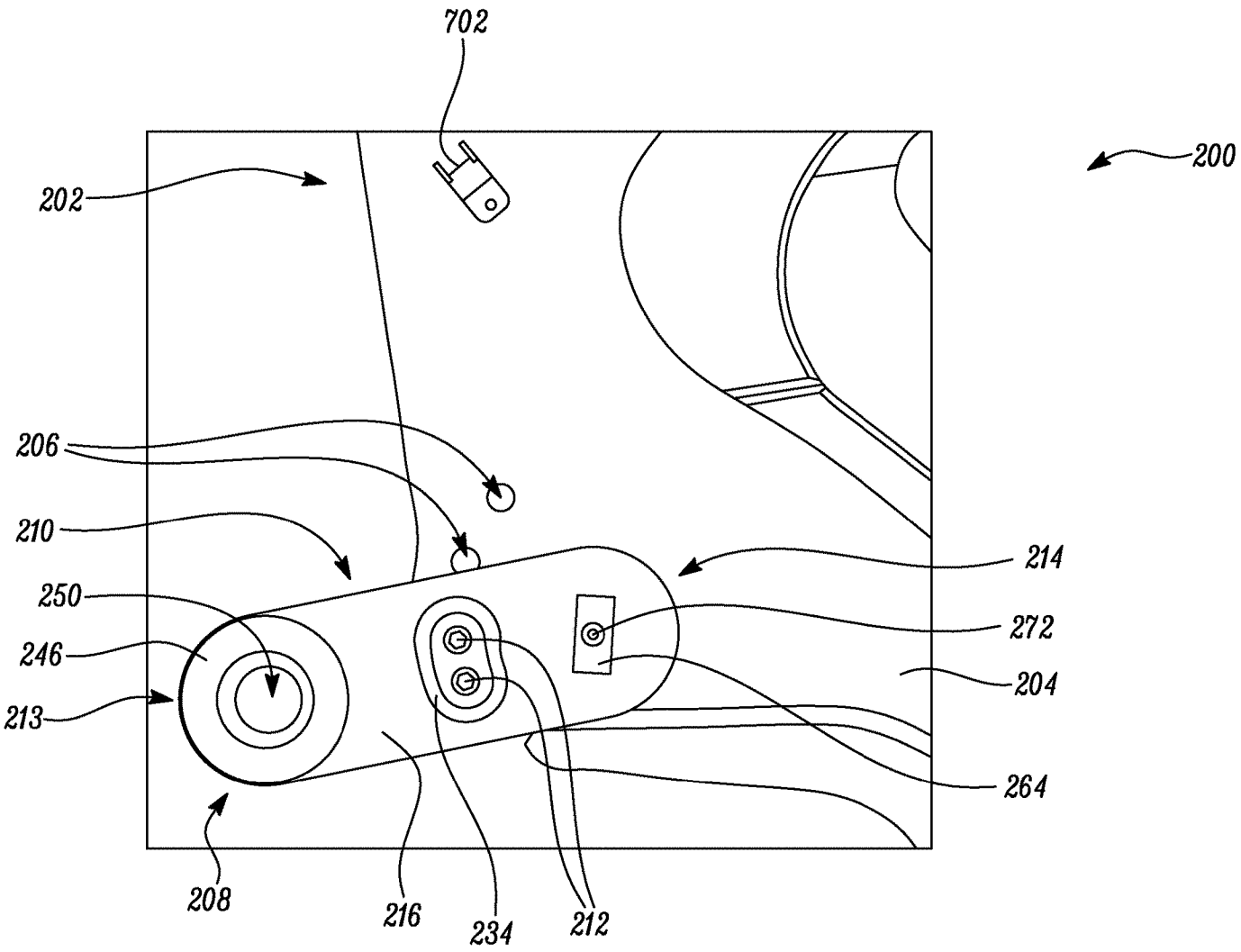
FIG. 2 is a schematic side view illustrating a portion of a bucket of the work machine of FIG. 1 and a hitch assembly associated with the bucket, according to an example of the present disclosure.

Referring now to FIG. 2, the bucket 202 includes a number of side walls 204 (only one of which is illustrated herein). For example, the bucket 202 may include three side walls 204 that together define a material receiving space of the bucket 202. The bucket 202 also includes a number of bucket holes 206 angularly spaced apart from each other. In some examples, the bucket 202 may include four bucket holes 206. However, a total number of the bucket holes 206 may vary, as per application requirements. The bucket 202 may also include a number of teeth (not shown) that may engage with a ground surface for excavation purposes. It should be noted that the bucket 202 may include any conventional bucket design known in the art.

The present disclosure relates to a hitch assembly 208 for the bucket 202 of the work machine 100 (see FIG. 1). Specifically, the bucket assembly 200 includes the hitch assembly 208 that is coupled to the bucket 202. The hitch assembly 208 allows the drag chains 136 (see FIG. 1) to be connected to the bucket 202 at a number of hitch locations. For example, the hitch assembly 208 may allow connection of the drag chains 136 at a higher hitch location when the bucket 202 is being used to dig deeper in the ground surface. Further, the hitch assembly 208 may allow connection of the drag chains 136 at a lower hitch location when the bucket 202 is being used to dig at a shallow depth.

It should be noted that the hitch assembly 208 described herein is associated with the side wall 204. However, another side wall of the bucket 202 that is spaced apart from the side wall 204 may also include a hitch assembly similar to the hitch assembly 208, without any limitations. Accordingly, the bucket 202 may include a pair of hitch assemblies (similar to the hitch assembly 208) associated therewith.

The hitch assembly 208 includes a bracket 210 that is removably coupled with the bucket 202 at any one of the number of hitch locations. Further, the hitch assembly 208 also includes one or more first mechanical fasteners 212 that removably couple the bracket 210 with the bucket 202. In the illustrated embodiment of FIG. 2, the hitch assembly 208 includes two first mechanical fasteners 212 that removably couple the bracket 210 with the bucket 202. The first mechanical fasteners 212 may include any one of a bolt, a pin, a screw, and the like.

Figure 3A:
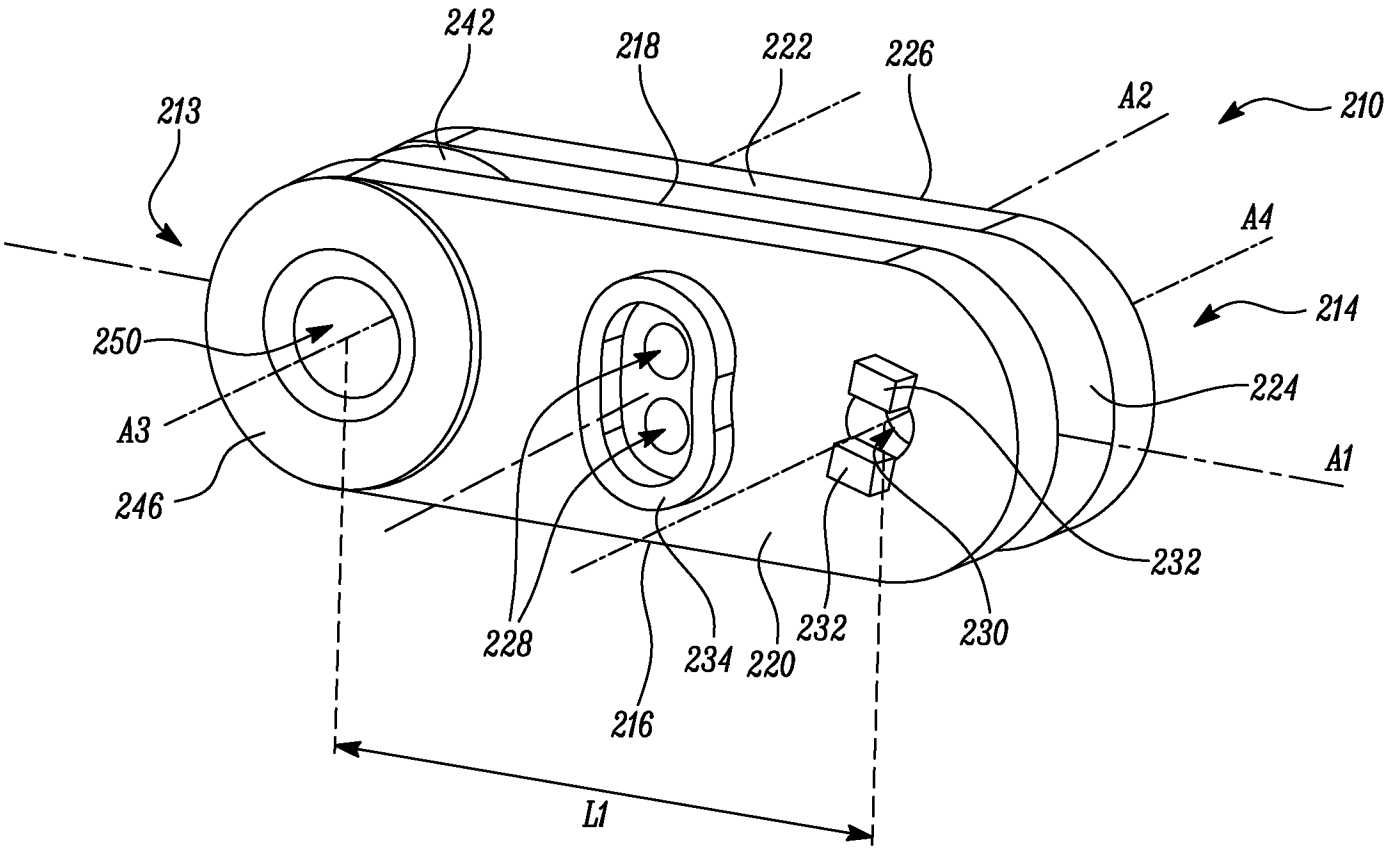
FIGS. 3A and 3B illustrate perspective views of a bracket of the hitch assembly of FIG. 2, according to an example of the present disclosure.
Figure 3B:
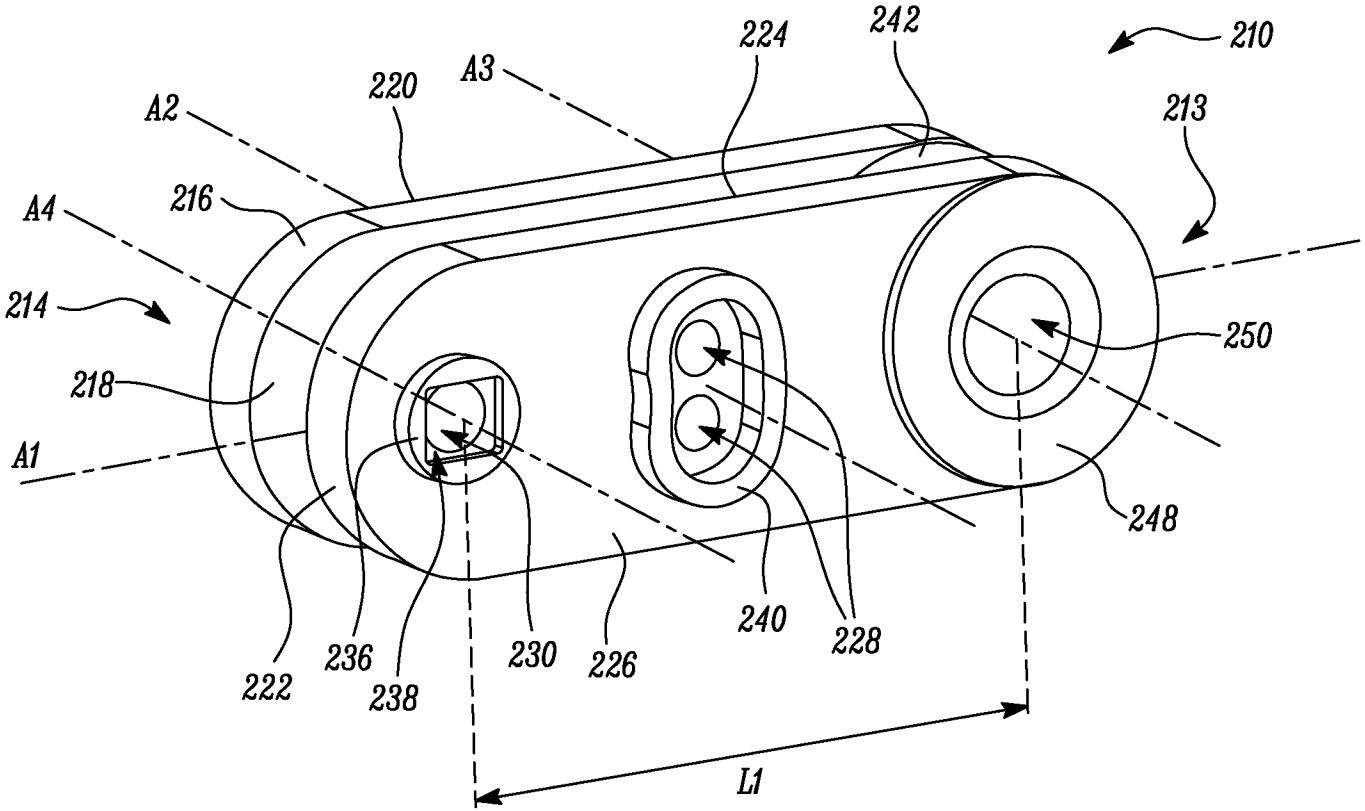

Referring to FIGS. 3A and 3B, the bracket 210 defines a longitudinal axis "A1" and a lateral axis "A2" extending orthogonal to the longitudinal axis "A1". The bracket 210 defines a first bracket end 213 and a second bracket end 214 opposite the first bracket end 213. Further, the bracket 210 is coupled with the drag chain 136 proximal to the first bracket end 213. In an example, a clevis type link may be used to connect the drag chain 136 to the bracket 210 at the first bracket end 213.

The bracket 210 includes a first plate member 216 defining a first inner surface 218 and a first outer surface 220. The bracket 210 also includes a second plate member 222 defining a second inner surface 224 and a second outer surface 226. Each of the first plate member 216 and the second plate member 222 extend along the longitudinal axis "A1" of the bracket 210 and are spaced apart from each other along the lateral axis "A2" of the bracket 210 that is orthogonal to the longitudinal axis "A1". Further, the first and second plate member 222 are similar to each other in terms of shape and dimensions. The first and second plate member 222 are substantially oval in shape.

Further, the bracket 210 defines one or more first through-holes 228. More particularly, the first plate member 216 and the second plate member 222 of the bracket 210 together define the one or more first through-holes 228. In the illustrated embodiment of FIG. 2, the bracket 210 defines two first through-holes 228. The one or more of the number of bucket holes 206 align with the one or more bucket holes 206 in the bucket 202 for receiving the one or more first mechanical fasteners 212 for removably coupling the bracket 210 with the bucket 202. Further, the bracket 210 also defines a second through-hole 230. More particularly, the first plate member 216 and the second plate member 222 of the bracket 210 together define the second through-hole 230. The second through-hole 230 is disposed proximal to the second bracket end 214.

As shown in FIG. 3A, the first plate member 216 includes a pair of first projections 232 extending along the lateral axis "A2" from the first outer surface 220. The pair of first projections 232 are disposed proximal to the second bracket end 214. The first projections 232 are arranged diametrically opposite to each other such that each first projection 232 is in communication with the second through-hole 230. Further, the first plate member 216 includes a first extending portion 234. The first extending portion 234 extends along the lateral axis "A2" from the first outer surface 220. The first extending portion 234 is disposed around the pair of first through-holes 228. In the illustrated embodiment of FIG. 3A, the first extending portion 234 is substantially oval in shape. It should be noted that a height of the first extending portion 234 is greater than a height of a portion of the first mechanical fasteners 212 that projects outward from the first outer surface 220, such that the first mechanical fasteners 212 are contained within the first extending portion 234.

As shown in FIG. 3B, the second plate member 222 includes a second projection 236 extending along the lateral axis "A2" from the second outer surface 226. The second projection 236 is disposed proximal to the second bracket end 214. The second projection 236 is circular in shape. Further, the second projection 236 defines a square cavity 238 that aligns with the second through-hole 230. Furthermore, the second plate member 222 includes a second extending portion 240. The second extending portion 240 extends along the lateral axis "A2" from the second outer surface 226. The second extending portion 240 is disposed around the pair of first through-holes 228. Further, the second extending portion 240 is in alignment with the first extending portion 234. In the illustrated embodiment of FIG. 3B, the second extending portion 240 is substantially oval in shape. Moreover, a height of the second extending portion 240 is greater than a height of a portion of the first mechanical fasteners 212 that projects outward from the second outer surface 226, such that the first mechanical fasteners 212 are contained within the second extending portion 240.

Figure 4:
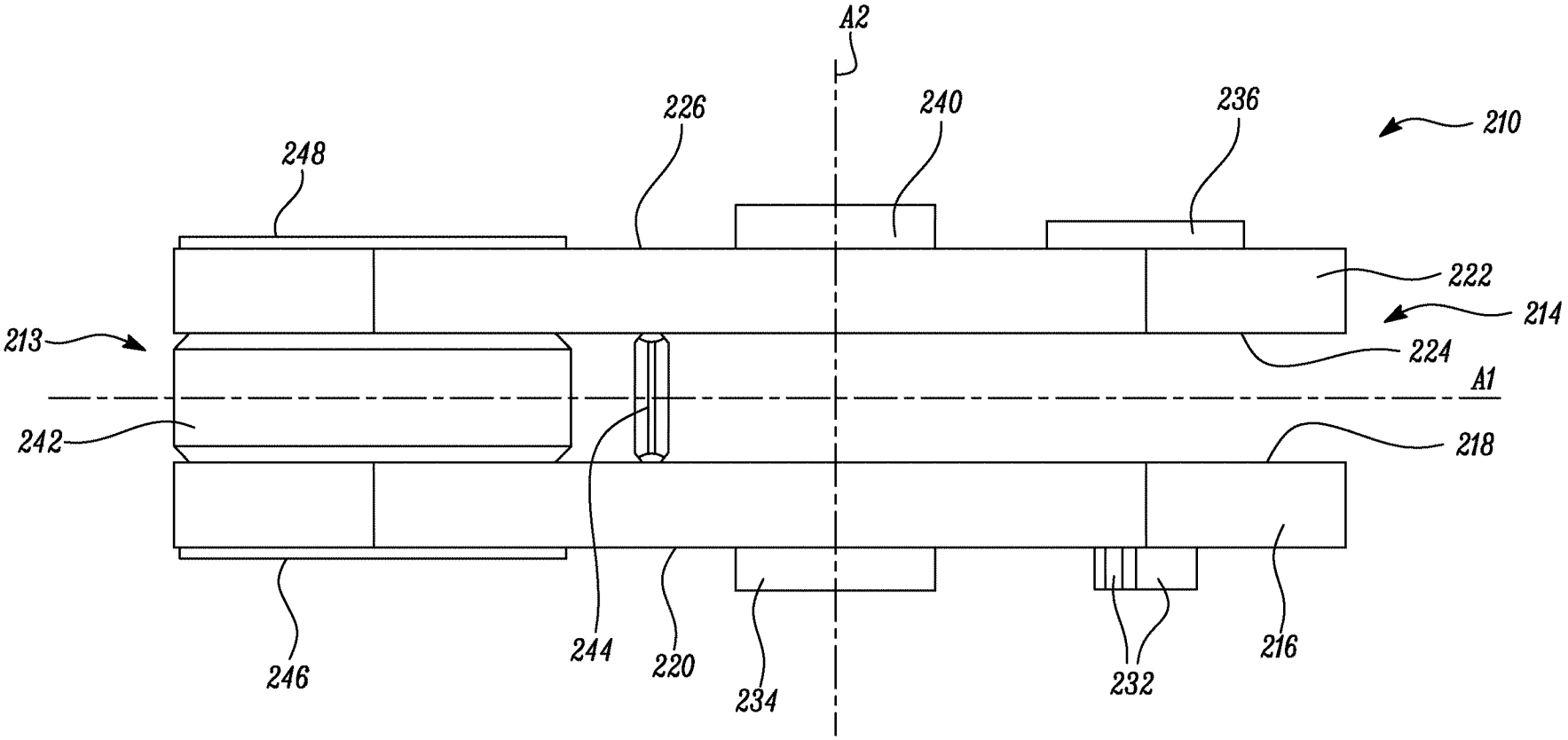
FIG. 4 is a schematic top view of the bracket of FIGS. 3A and 3B.

Referring now to FIG. 4, the hitch assembly 208 further includes a hub member 242 extending along the lateral axis "A2" between the first plate member 216 and the second plate member 222. The hub member 242 is connected to each of the first plate member 216 at the first inner surface 218 and the second plate member 222 at the second inner surface 224. Further, a spacer 244 is disposed between the first plate member 216 and the second plate member 222. The spacer 244 is disposed adjacent to the hub member 242.

The bracket 210 includes a first thrust hub 246 disposed on the first outer surface 220 and a second thrust hub 248 disposed on the second outer surface 226. Each of the first thrust hub 246 and the second thrust hub 248 is in alignment with the hub member 242. Further, each of the first thrust hub 246, the first plate member 216, the hub member 242, the second plate member 222, and the second thrust hub 248 together define a through-opening 250 proximal to the first bracket end 213. The through-opening 250 of the bracket 210 allows coupling of the drag chain 136 with the bracket 210. The bracket 210 defines a length L1 along the longitudinal axis "A1". The length "L1" is defined between a central axis A3 of the through-opening 250 and a central axis A4 of the second through-hole 230.

In some examples, the bracket 210 may be embodied as a single integral component. In an example, the bracket 210 may be manufactured as a single component by casting or forging. Alternatively, various components of the bracket 210 may be manufactured separately and may be connected to each other by a known joining process, such as, welding.

Figure 5:
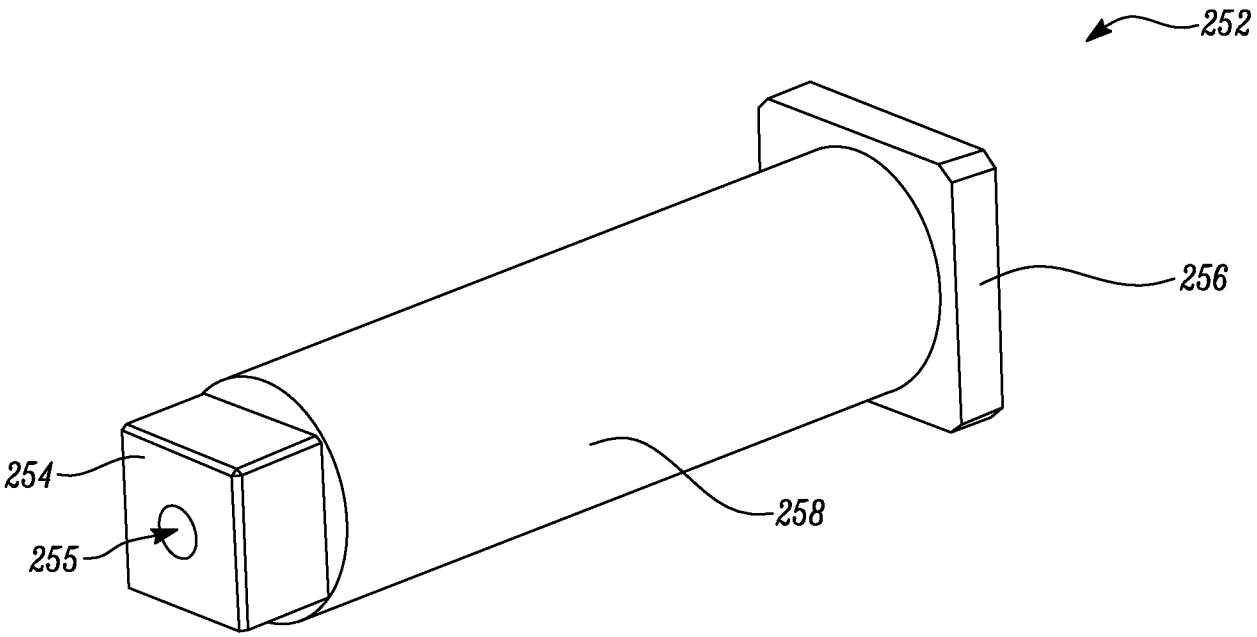
FIG. 5 is a perspective view of a second mechanical fastener associated with the hitch assembly of FIG. 2, according to an example of the present disclosure.
Figure 6:
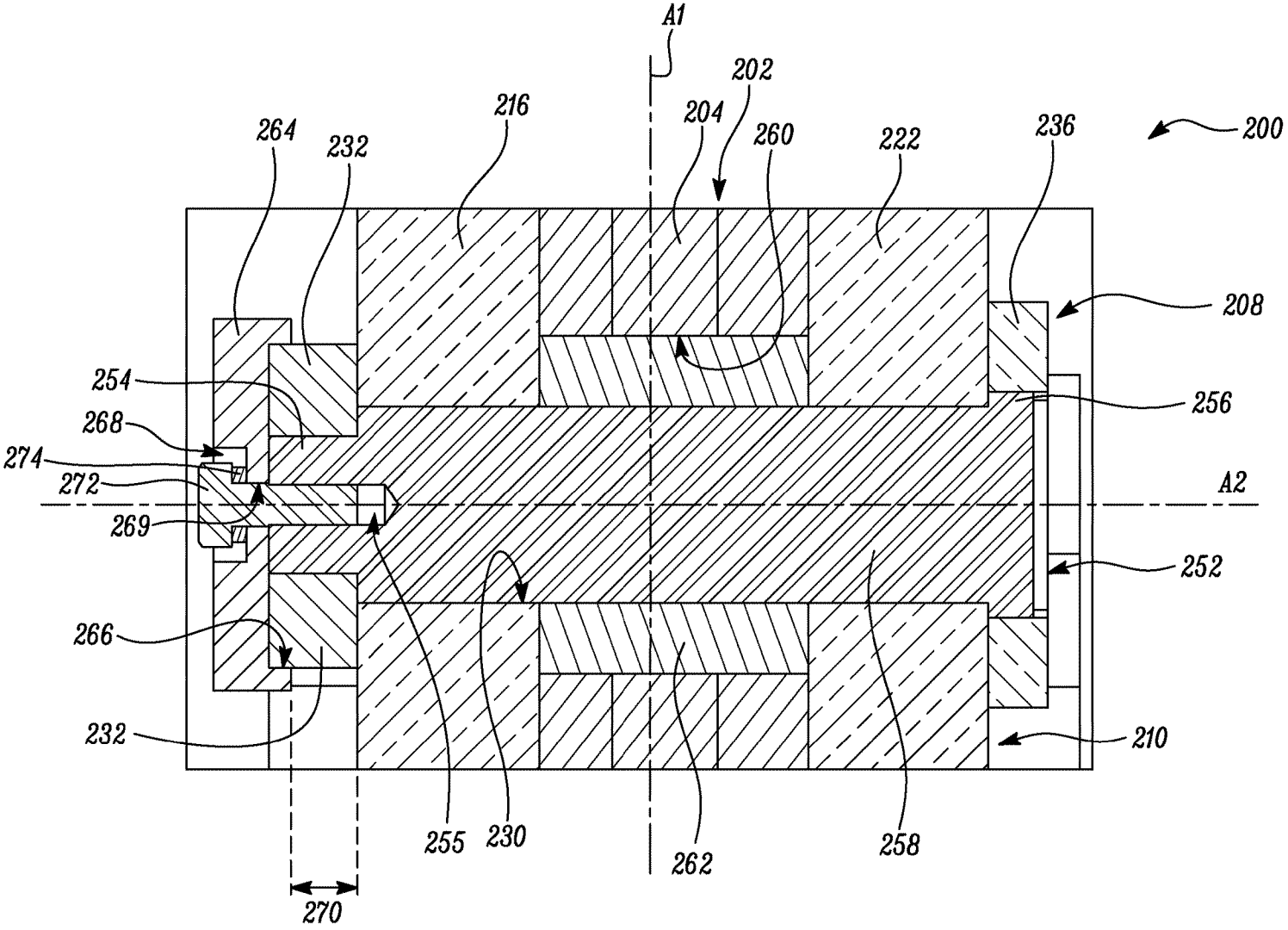
FIG. 6 is a cross-sectional view of the hitch assembly of FIG. 2 coupled to the bucket.

Referring now to FIGS. 5 and 6, the hitch assembly 208 includes a second mechanical fastener 252 coupled with each of the bucket 202 and the bracket 210 proximal to the second bracket end 214. Based on a removal of the one or more first mechanical fasteners 212 from the bucket 202 and the bracket 210, the bracket 210 and the second mechanical fastener 252 rotate relative to the bucket 202 for disposing the bracket 210 at any one of the number of hitch locations.

The second mechanical fastener 252 may be embodied as a pivot pin that allow pivoting of the bracket 210 relative to the bucket 202. The second mechanical fastener 252 includes a first polygonal end 254, a second polygonal end 256 opposite the first polygonal end 254, and a cylindrical portion 258 extending between the first polygonal end 254 and the second polygonal end 256. The first polygonal end 254 locks with the first plate member 216. In other words, when the second mechanical fastener 252 is coupled to the bucket 202 and the bracket 210, the first polygonal end 254 of the second mechanical fastener 252 locks with each of the pair of first projections 232. A locking of the second mechanical fastener 252 with each of the pair of first projections 232 prevents a rotation of the second mechanical fastener 252 relative to the bracket 210. In the illustrated embodiment of FIGS. 5 and 6, the first polygonal end 254 is square in shape. Alternatively, the first polygonal end 254 may be rectangular in shape, hexagonal in shape, and the like. Further, the first polygonal end 254 defines a threaded hole 255.

Further, the second polygonal end 256 locks with the second plate member 222. In other words, when the second mechanical fastener 252 is coupled to the bucket 202 and the bracket 210, the second polygonal end 256 of the second mechanical fastener 252 locks with the second projection 236. A locking of the second mechanical fastener 252 with the second projection 236 prevents the rotation of the second mechanical fastener 252 relative to the bracket 210. In the illustrated embodiment of FIGS. 5 and 6, the second polygonal end 256 is square in shape. Alternatively, the second polygonal end 256 may be rectangular in shape, hexagonal in shape, and the like. It should be noted that a cross-sectional area of the first polygonal end 254 may be smaller than a cross-sectional of the second polygonal end 256 and the cylindrical portion 258.

Further, the cylindrical portion 258 of the second mechanical fastener 252 is received within the second through-hole 230 in the bracket 210 and a through-opening 260 in the bucket 202. In some examples, a bushing 262 may be disposed between the bucket 202 and the cylindrical portion 258 of the second mechanical fastener 252.

Further, when the bracket 210 is rotated, the first polygonal end 254, the second polygonal end 256, and the cylindrical portion 258 rotate with the bracket 210. Moreover, when the bracket 210 is rotated, the first polygonal end 254, the second polygonal end 256, and the cylindrical portion 258 rotate relative to the bucket 202. It should be noted that the second mechanical fastener 252 may be manufactured by coupling the first and second polygonal ends 254, 256 with the cylindrical portion 258 by a joining process, such as, welding, soldering, brazing, and the like. For example, the first and second polygonal ends 254, 256 may be embodied as weld-on heads. Alternatively, the first polygonal end 254, the second polygonal end 256, and the cylindrical portion 258 may be integrally formed. For example, the second mechanical fastener 252 may be manufactured by castor or forging. The second mechanical fastener 252 may include any one of a bolt, a pin, a screw, and the like. In some examples, the second mechanical fastener 252 may include snap rings to hold the second mechanical fastener 252 in place. In other examples, the second mechanical fastener 252 may include a combination of a bolt, a washer, and a nut.

Further, the hitch assembly 208 includes a locking plate 264 coupled with each of the bracket 210 and the second mechanical fastener 252. The locking plate 264 at least partially receive each of the pair of first projections 232 and the first polygonal end 254. The locking plate 264 is substantially rectangular in shape and defines a rectangular cavity 266. The rectangular cavity 266 of the locking plate 264 partially receives the pair of first projections 232 and the first polygonal end 254 therein. The locking plate 264 also defines a slot 268 and a through-hole 269 that is concentric with the slot 268. In one example, the slot 268 may be circular in shape. Further, when the locking plate 264 is coupled with the bracket 210 and the second mechanical fastener 252, a gap 270 exists between the bracket 210 and the locking plate 264.

The hitch assembly 208 further includes a third mechanical fastener 272 that couples the locking plate 264 with the second mechanical fastener 252. The third mechanical fastener 272 is received within the through-hole 269 in the locking plate 264 and the threaded hole 255 in the first polygonal end 254. When the third mechanical fastener 272 is coupled to the locking plate 264 and the second mechanical fastener 252, a head of the third mechanical fastener 272 is at least partially received within the slot 268 of the locking plate 264. The third mechanical fastener 272 and the locking plate 264 together retain the second mechanical fastener 252 in coupling with the bracket 210, and prevents a removal of the second mechanical fastener 252 from the bracket 210. The third mechanical fastener 272 may include a bolt, a pin, a screw, and the like. Further, a washer 274 is disposed between the third mechanical fastener 272 and the locking plate 264.

Figure 7:
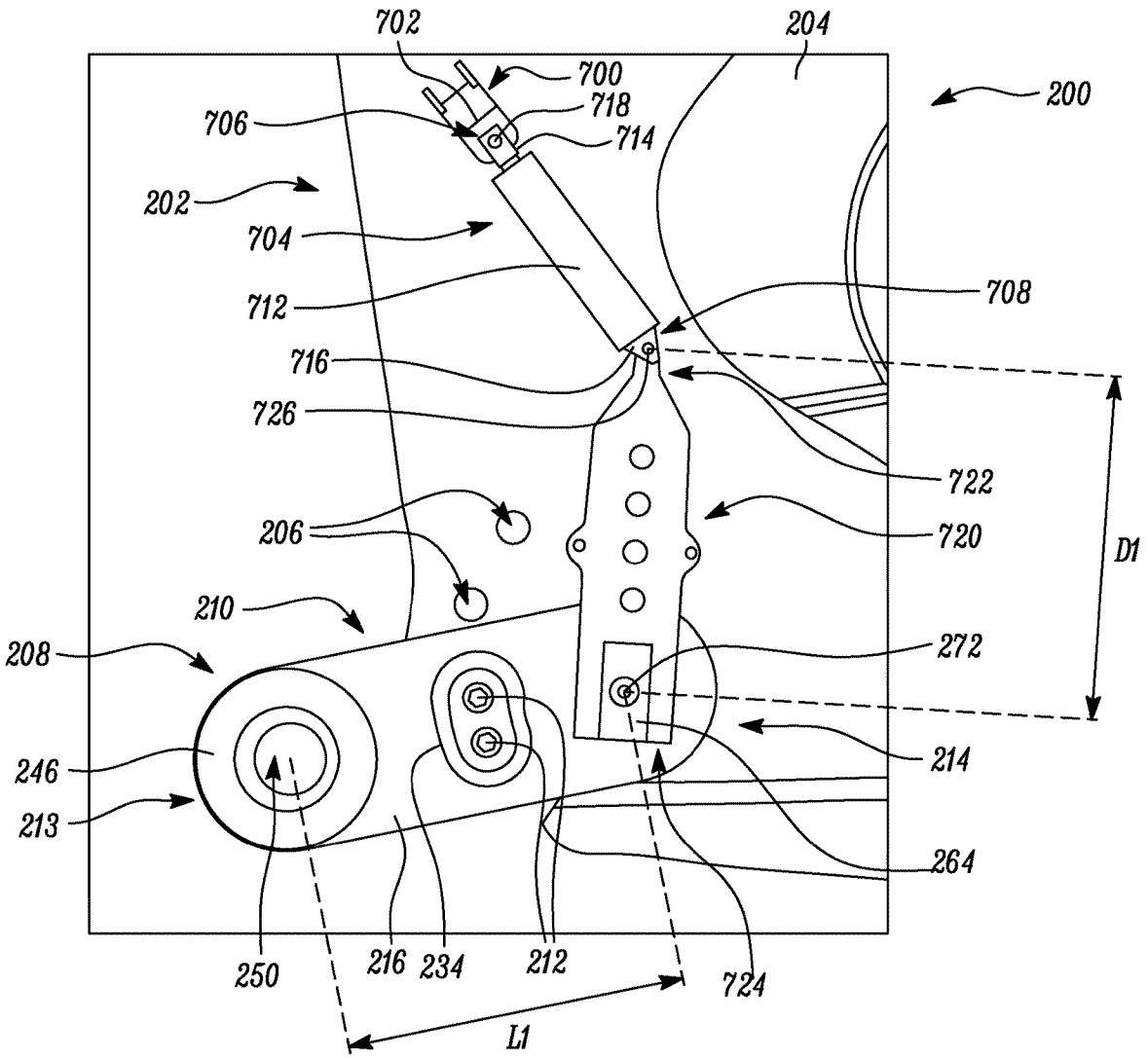
FIG. 7 is a schematic side view illustrating an adjustment mechanism coupled with the hitch assembly of FIG. 2, according to an example of the present disclosure.

Referring now to FIG. 7, the hitch assembly 208 also includes an adjustment mechanism 700 for adjusting a position of the bracket 210 relative to the bucket 202. The adjustment mechanism 700 includes an adjustment bracket 702 coupled with the bucket 202. The adjustment bracket 702 may be mounted high enough so that the adjustment bracket 702 does not lie in a main path of soil or other materials present on the ground surface. In an example, the adjustment bracket 702 is welded to the side wall 204 of the bucket 202. Alternatively, the adjustment bracket 702 may be coupled with the bucket 202 by one or more mechanical fasteners.

Further, the adjustment mechanism 700 includes an actuation device 704 defining a first end 706 and a second end 708. The actuation device 704 is embodied as an actuator herein. Alternatively, the actuation device 704 may include any other device, such as, a turn buckle. The actuation device 704 includes a rod 710 (shown in FIG. 10) and a cylinder 712. The rod 710 defines the first end 706 of the actuation device 704, whereas the cylinder 712 defines the second end 708 of the actuation device 704. The actuation device 704 includes a first connecting bracket 714 connected to the rod 710 at the first end 706 and a second connecting bracket 716 connected to the cylinder 712 at the second end 708. The actuation device 704 is coupled with the adjustment bracket 702 at the first end 706 of the actuation device 704. Specifically, the first connecting bracket 714 is removably connected to the adjustment bracket 702. The actuation device 704 is coupled with the adjustment bracket 702 using a mechanical fastener 718. The mechanical fastener 718 may include a bolt, a pin, a screw, and the like.

The adjustment mechanism 700 further includes a lever 720 defining a first coupling end 722 and a second coupling end 724. The first coupling end 722 of the lever 720 is coupled with the actuation device 704 at the second end 708 of the actuation device 704. Specifically, the second connecting bracket 716 of the actuation device 704 is removably connected to the lever 720. The actuation device 704 is coupled with the lever 720 using a mechanical fastener 726. The mechanical fastener 726 may include a bolt, a pin, a screw, and the like. When the lever 720 is assembled with the bracket 210, the lever 720 defines a distance "D1" between the first coupling end 722 and the central axis "A4". The distance "D1" is greater than the length "L1" defined by the bracket 210 such that the mechanical advantage is greater than 1. This feature may allow the actuation device 704 to be smaller and easier to handle.

Figure 8:
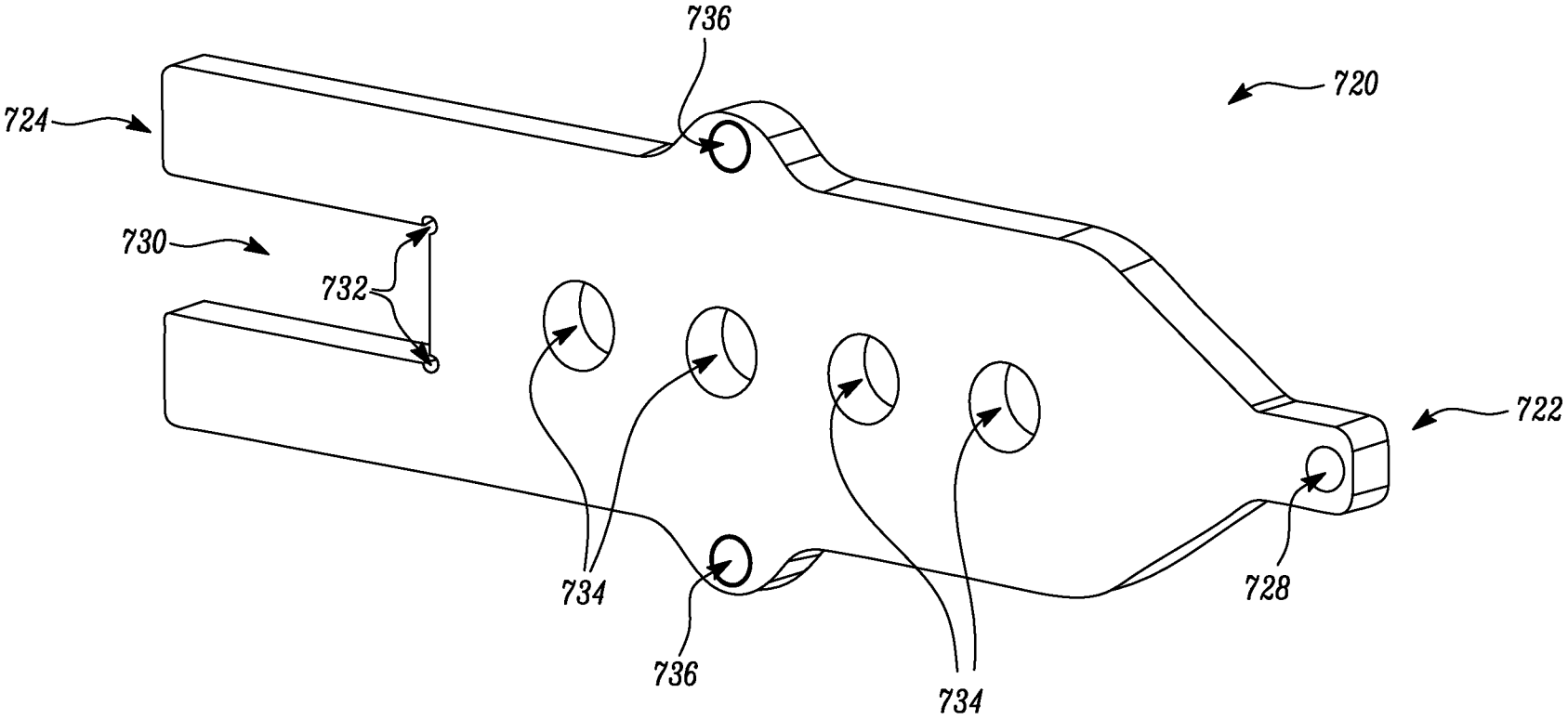
FIG. 8 is a perspective view of a lever associated with the adjustment mechanism of FIG. 7.

As shown in FIG. 8, the first coupling end 722 of the lever 720 includes a through-hole 728 that allows receipt of the mechanical fastener 726 (see FIG. 7) for coupling the lever 720 with the actuation device 704. Further, the lever 720 defines a cut-out 730 proximal to the second coupling end 724 of the lever 720. The lever 720 also defines a pair of additional cut-outs 732 that face the cut-out 730 for reducing stress concentration. The lever 720 further defines a number of openings 734 that reduce a weight of the lever 720. Moreover, the lever 720 defines a pair of lifting lugs 736 that may allow lifting and placement of the lever 720. The lifting lugs 736 are centrally located along a length of the lever 720. It should be noted that a design of the lever 720 as described herein is exemplary in nature and the lever 720 may include any other shape or design, without any limitations. It should be noted that the details provided herein for the adjustment mechanism 700 is exemplary in nature and the bracket 210 may be moved between different hitch locations using any other combination of components. In some examples, it may be contemplated that the adjustment mechanism 700 may couple with the spacer 244 of the bracket 210 to move the bracket 210 between different hitch locations.

Figure 9:
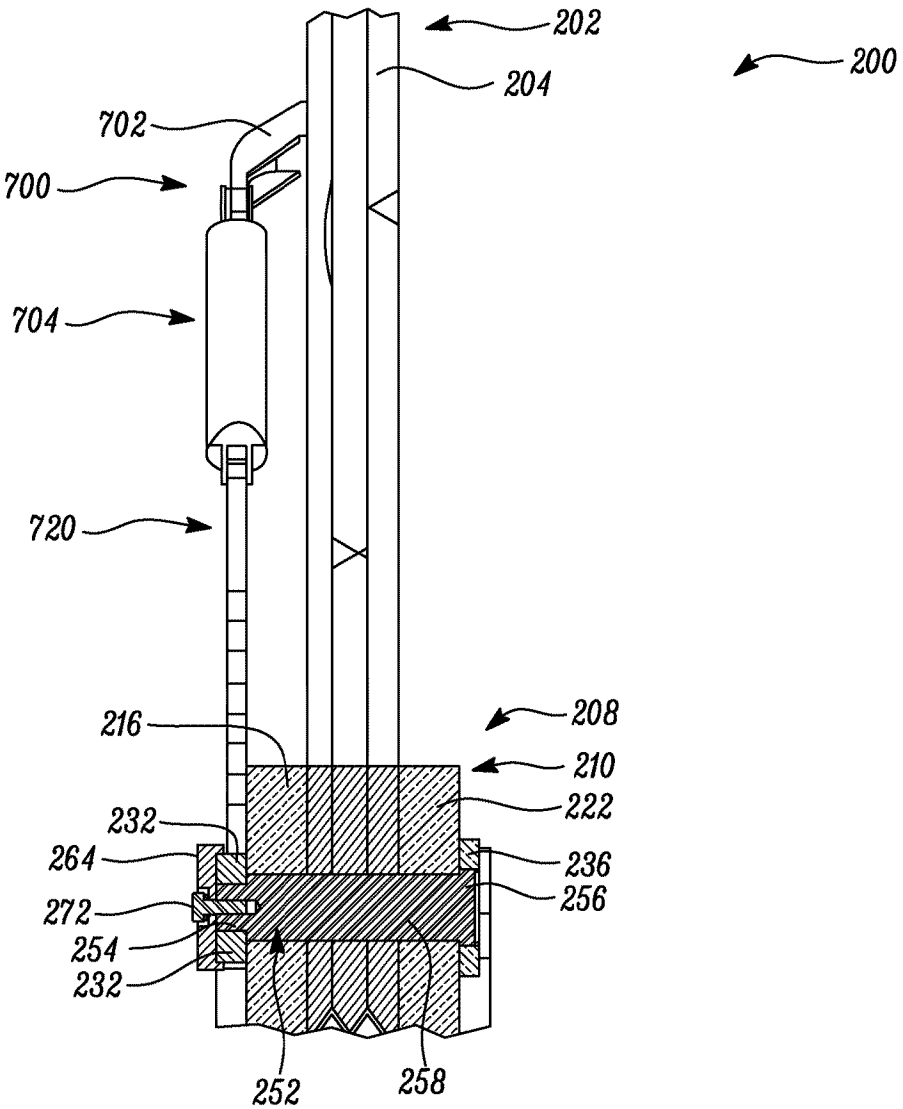
FIG. 9 is a cross-sectional view of the adjustment mechanism of FIG. 7 coupled with the bracket of FIGS. 3A and 3B.
Figure 10:
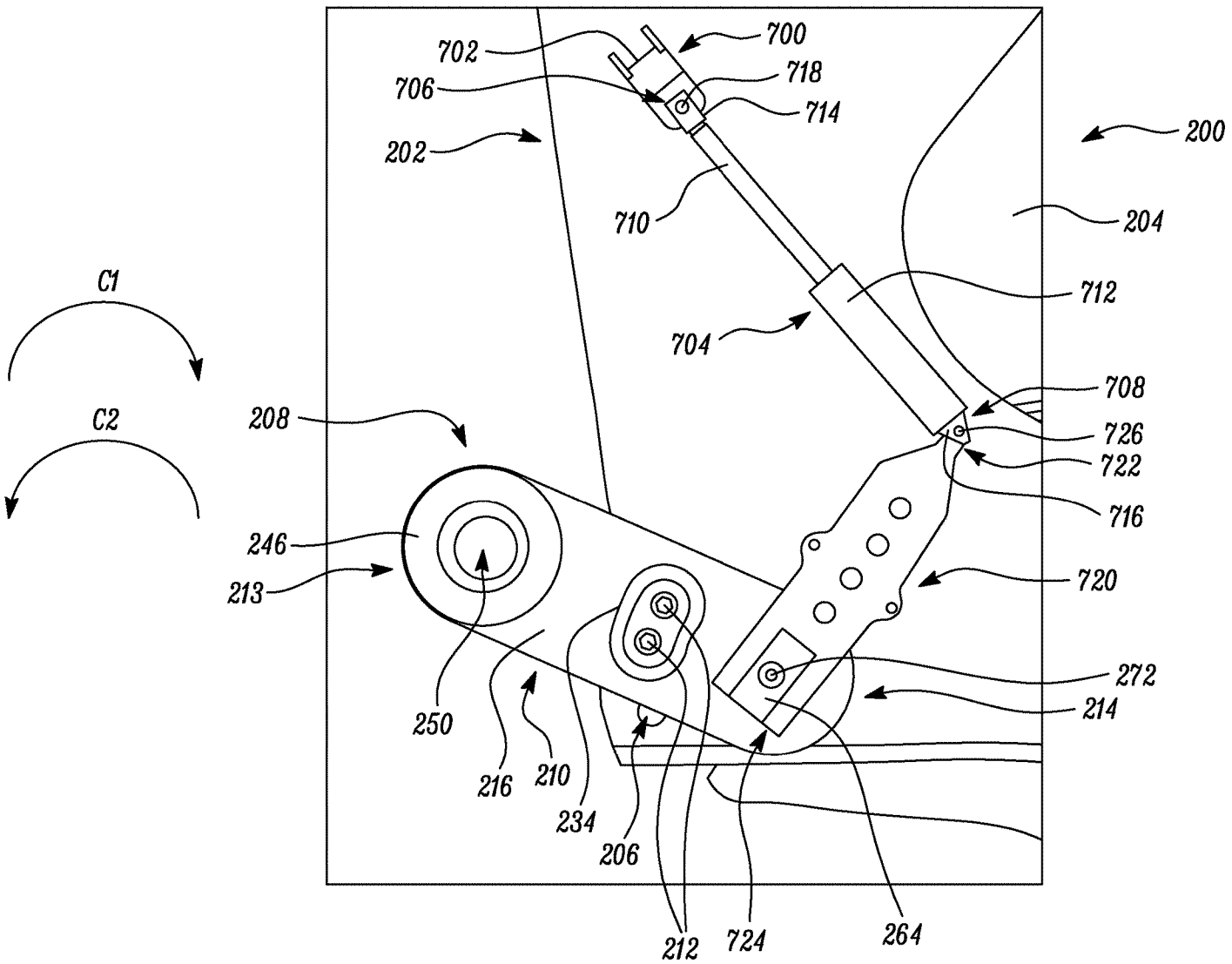
FIG. 10 is a schematic side view illustrating the adjustment mechanism of FIG. 7, according to an example of the present disclosure.

As shown in FIG. 9, when the bracket 210 is to be disposed at another hitch location (for example, a higher hitch location as illustrated in FIG. 10), the first mechanical fasteners 212 (see FIG. 7) are removed from the bucket 202 and the bracket 210. Subsequently, the adjustment mechanism 700 is coupled with the bracket 210. More particularly, the actuation device 704 is coupled to the adjustment bracket 702. Further, the lever 720 is coupled with the actuation device 704. The actuation device 704 rotates the lever 720 in a clockwise direction "C1" (see FIG. 10) or an anti-clockwise direction "C2" (see FIG. 10). Moreover, the lever 720 is coupled with the bracket 210 and the second mechanical fastener 252. Specifically, the cut-out 730 (see FIG. 8) of the lever 720 engages with the bracket 210 and the second mechanical fastener 252, such that a rotation of the lever 720 in the clockwise direction "C1" or the anti-clockwise direction "C2" rotates the bracket 210 relative to the bucket 202 for disposing the bracket 210 at any one of the number of hitch locations. It should be noted that the cut-out 730 of the lever 720 engages with the first projections 232 and the first polygonal end 254 in order to rotate the bracket 210 and the second mechanical fastener 252 relative to the bucket 202. It should be further noted that, when the lever 720 is coupled with the bracket 210 and the second mechanical fastener 252, the lever 720 is disposed in the gap 270 (see FIG. 7) between the locking plate 264 and the bracket 210.

Referring now to FIG. 10, in order to dispose the bracket 210 at the higher hitch location, the first mechanical fasteners 212 are removed and the adjustment mechanism 700 is assembled. Further, the rod 710 of the actuation device 704 is extended such that the lever 720 rotates in the clockwise direction "C1", thereby causing the bracket 210 to rotate in the clockwise direction "C1". Further, the rod 710 may extend until the first through-holes 228 of the bracket 210 are in alignment with corresponding bucket holes 206 in the bucket 202. Subsequently, the first mechanical fasteners 212 are coupled to the bucket 202 and the bracket 210 for disposing the bracket 210 at the higher hitch location.

Alternatively, when the bracket 210 is to be disposed at the lower hitch location (as illustrated in FIG. 7), the rod 710 of the actuation device 704 may be retracted such that the lever 720 rotates in the anti-clockwise direction "C2", thereby causing the bracket 210 to rotate in the anti-clockwise direction "C2". Further, the rod 710 may retract until the first through-holes 228 of the bracket 210 are in alignment with corresponding bucket holes 206 in the bucket 202. Subsequently, the first mechanical fasteners 212 are coupled to the bucket 202 and the bracket 210 for disposing the bracket 210 at the lower hitch location.

INDUSTRIAL APPLICABILITY

The present disclosure relates to the hitch assembly 208 associated with the bucket 202. The hitch assembly 208 includes the bracket 210 that may be disposed at different hitch locations. For example, when the bucket 202 is required to dig deeper into the ground surface, the bracket 210 may be moved to a higher hitch location, which may allow teeth of the bucket 202 to engage into soil without the bucket 202 heeling over. The bracket 210 includes the first and second thrust hubs 246, 248 that may reduce wear and tear of the first and second plate members 216, 222 caused by contact of the bracket 210 with the drag chain 136. Moreover, the first and second extending portions 234, 240 may prevent wear and tear of the first mechanical fasteners 212 as the first mechanical fasteners 212 are contained within the first and second extending portions 234, 240. Moreover, the second mechanical fastener 252 is protected from wear by the first projections 232, the locking plate 264, and the second projection 236.

Further, the hitch assembly 208 as described herein includes the adjustment mechanism 700 that allows the bracket 210 to be easily moved between different hitch locations. Thus, a personnel may not have to manually move the bracket 210, thereby reducing efforts. Moreover, the adjustment bracket 702 may be fixedly coupled with the side wall 204 of the bucket 202. The adjustment bracket 702 may be mounted high enough, such that, it is protected from wear and tear. Further, the lever 720 of the adjustment mechanism 700 may be easy to handle as it may be lightweight by virtue of the various openings 734 defined therein. Furthermore, the lever 720 includes the lifting lugs 736 that may allow easy placement and lifting of the lever 720 during assembling and disassembling of the adjustment mechanism 700.

The hitch assembly 208 as described herein may be easy to use and may be cost-effective to incorporate. Further, the hitch assembly 208 may be easily retrofitted on existing buckets with minimum modifications. It should be further noted that the hitch assembly 208 as described herein may be incorporated on different types of buckets.

While aspects of the present disclosure have been particularly shown and described with reference to the embodiments above, it will be understood by those skilled in the art that various additional embodiments may be contemplated by the modification of the disclosed work machines, systems and methods without departing from the spirit and scope of the disclosure. Such embodiments should be understood to fall within the scope of the present disclosure as determined based upon the claims and any equivalents thereof.

What is claimed is:

1. A hitch assembly for a bucket of a work machine, the hitch assembly comprising:

a bracket adapted to be removably coupled with the bucket at any one of a plurality of hitch locations, wherein the bracket includes a first plate member, a second plate member, and a hub member connected at a first inner surface of the first plate member and a second inner surface of the second plate member, wherein the bracket defines a first bracket end and a second bracket end opposite the first bracket end, and wherein the bracket is adapted to be coupled with a drag chain proximal to the first bracket end;

one or more first mechanical fasteners adapted to removably couple the bracket with the bucket; and a second mechanical fastener adapted to be coupled with each of the bucket and the bracket proximal to the second bracket end, wherein, based on a removal of the one or more first mechanical fasteners from the bucket and the bracket, the bracket and the second mechanical fastener is adapted to rotate relative to the bucket for disposing the bracket at any one of the plurality of hitch locations.

2. The hitch assembly of claim 1, wherein:

the first plate member defines the first inner surface and a first outer surface;

the second plate member defines the second inner surface and a second outer surface;

the first plate member and the second plate member extend along a longitudinal axis of the bracket and are spaced apart from each other along a lateral axis of the bracket that is orthogonal to the longitudinal axis; and the hub member extends along the lateral axis.

3. The hitch assembly of claim 2, wherein the bracket includes a first thrust hub disposed on the first outer surface and a second thrust hub disposed on the second outer surface, and wherein each of the first thrust hub and the second thrust hub is in alignment with the hub member.

4. The hitch assembly of claim 2, wherein the second mechanical fastener includes a first polygonal end, a second polygonal end opposite the first polygonal end, and a cylindrical portion extending between the first polygonal end and the second polygonal end, wherein the first polygonal end is adapted to lock with the first plate member, the second polygonal end is adapted to lock with the second plate member, and wherein the cylindrical portion is rotatable relative to the bucket.

5. The hitch assembly of claim 4, wherein the first plate member includes a pair of first projections extending along the lateral axis from the first outer surface, and wherein the first polygonal end of the second mechanical fastener is adapted to lock with each of the pair of first projections.

6. The hitch assembly of claim 5 further comprising:

a locking plate adapted to be coupled with each of the bracket and the second mechanical fastener, wherein the locking plate is adapted to at least partially receive each of the pair of first projections and the first polygonal end; and a third mechanical fastener adapted to couple the locking plate with the second mechanical fastener.

7. The hitch assembly of claim 4, wherein the second plate member includes a second projection extending along the lateral axis from the second outer surface, and wherein the second polygonal end of the second mechanical fastener is adapted to lock with the second projection.

8. The hitch assembly of claim 1, wherein the bucket includes a plurality of bucket holes angularly spaced apart from each other, wherein the bracket defines one or more first through-holes, and wherein one or more of the plurality of bucket holes align with the one or more first through-holes for receiving the one or more first mechanical fasteners for removably coupling the bracket with the bucket.

9. The hitch assembly of claim 1 further comprising an adjustment mechanism for adjusting a position of the bracket relative to the bucket, wherein the adjustment mechanism includes:

an adjustment bracket coupled with the bucket;

an actuation device defining a first end and a second end, wherein the actuation device is adapted to be coupled with the adjustment bracket at the first end of the actuation device; and a lever defining a first coupling end and a second coupling end, wherein the first coupling end of the lever is adapted to be coupled with the actuation device at the second end of the actuation device, wherein the actuation device is adapted to rotate the lever in at least one of a clockwise direction and an anti-clockwise direction, and wherein the lever defines a cut-out proximal to the second coupling end of the lever.

10. The hitch assembly of claim 9, wherein the cut-out of the lever is adapted to engage with the bracket and the second mechanical fastener, such that a rotation of the lever in at least one of the clockwise direction and the anti-clockwise direction rotates the bracket relative to the bucket for disposing the bracket at any one of the plurality of hitch locations.

11. A bucket assembly for a work machine, the bucket assembly comprising:

a bucket; and a hitch assembly adapted to be coupled to the bucket, the hitch assembly comprising:

a bracket adapted to be removably coupled with the bucket at any one of a plurality of hitch locations, wherein the bracket includes a first plate member, a second plate member, and a hub member connected at a first inner surface of the first plate member and a second inner surface of the second plate member, wherein the bracket defines a first bracket end and a second bracket end opposite the first bracket end, and wherein the bracket is adapted to be coupled with a drag chain proximal to the first bracket end;

one or more first mechanical fasteners adapted to removably couple the bracket with the bucket; and a second mechanical fastener adapted to be coupled with each of the bucket and the bracket proximal to the second bracket end, wherein, based on a removal of the one or more first mechanical fasteners from the bucket and the bracket, the bracket and the second mechanical fastener is adapted to rotate relative to the bucket for disposing the bracket at any one of the plurality of hitch locations.

12. The bucket assembly of claim 11, wherein:

the first plate member defines the first inner surface and a first outer surface;

the second plate member defines the second inner surface and a second outer surface;

the first plate member and the second plate member extend along a longitudinal axis of the bracket and are spaced apart from each other along a lateral axis of the bracket that is orthogonal to the longitudinal axis; and the hub member extends along the lateral axis.

13. The hitch assembly of claim 12, wherein the bracket includes a first thrust hub disposed on the first outer surface and a second thrust hub disposed on the second outer surface, and wherein each of the first thrust hub and the second thrust hub is in alignment with the hub member.

14. The bucket assembly of claim 12, wherein the second mechanical fastener includes a first polygonal end, a second polygonal end opposite the first polygonal end, and a cylindrical portion extending between the first polygonal end and the second polygonal end, wherein the first polygonal end is adapted to lock with the first plate member, the second polygonal end is adapted to lock with the second plate member, and wherein the cylindrical portion is rotatable relative to the bucket.

15. The bucket assembly of claim 14, wherein the first plate member includes a pair of first projections extending along the lateral axis from the first outer surface, and wherein the first polygonal end of the second mechanical fastener is adapted to lock with each of the pair of first projections.

16. The bucket assembly of claim 15, wherein the hitch assembly further includes:

a locking plate adapted to be coupled with each of the bracket and the second mechanical fastener, wherein the locking plate is adapted to at least partially receive each of the pair of first projections and the first polygonal end; and a third mechanical fastener adapted to couple the locking plate with the second mechanical fastener.

17. The bucket assembly of claim 14, wherein the second plate member includes a second projection extending along the lateral axis from the second outer surface, and wherein the second polygonal end of the second mechanical fastener is adapted to lock with the second projection.

18. The bucket assembly of claim 11, wherein the bucket includes a plurality of bucket holes angularly spaced apart from each other, and wherein the bracket defines one or more first through-holes, wherein one or more of the plurality of bucket holes align with the one or more first through-holes for receiving the one or more first mechanical fasteners for removably coupling the bracket with the bucket.

19. The bucket assembly of claim 11 further comprising an adjustment mechanism for adjusting a position of the bracket relative to the bucket, wherein the adjustment mechanism includes:

an adjustment bracket coupled with the bucket;

an actuation device defining a first end and a second end, wherein the actuation device is adapted to be coupled with the adjustment bracket at the first end of the actuation device; and a lever defining a first coupling end and a second coupling end, wherein the first coupling end of the lever is adapted to be coupled with the actuation device at the second end of the actuation device, wherein the actuation device is adapted to rotate the lever in at least one of a clockwise direction and an anti-clockwise direction, and wherein the lever defines a cut-out proximal to the second coupling end of the lever.

20. The bucket assembly of claim 19, wherein the cut-out of the lever is adapted to engage with the bracket and the second mechanical fastener, such that a rotation of the lever in at least one of the clockwise direction and the anti-clockwise direction rotates the bracket relative to the bucket for disposing the bracket at any one of the plurality of hitch locations.

* * * * *